US007806717B2

(12) United States Patent
Nakano

(10) Patent No.: US 7,806,717 B2
(45) Date of Patent: Oct. 5, 2010

(54) CONNECTOR WITH A COVER WITH WIRE GUIDES BENDING A WIRE IN OPPOSITE DIRECTIONS

(75) Inventor: Hiroshi Nakano, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 12/547,864

(22) Filed: Aug. 26, 2009

(65) Prior Publication Data

US 2010/0055963 A1 Mar. 4, 2010

(30) Foreign Application Priority Data

Sep. 4, 2008 (JP) ..... 2008-227405

(51) Int. Cl.
*H01R 13/62* (2006.01)

(52) U.S. Cl. ..... 439/367

(58) Field of Classification Search ..... 439/367, 439/449, 456, 521, 587, 379
See application file for complete search history.

(56) References Cited

U.S. PATENT DOCUMENTS

| | | | | |
|---|---|---|---|---|
| 5,830,006 | A * | 11/1998 | Koumatsu et al. | 439/449 |
| 6,217,344 | B1 * | 4/2001 | Saito et al. | 439/67 |
| 6,478,607 | B2 * | 11/2002 | Tabata | 439/456 |
| 6,659,792 | B2 * | 12/2003 | Saka et al. | 439/367 |
| 2008/0083557 | A1 * | 4/2008 | Kobayashi et al. | 174/168 |

FOREIGN PATENT DOCUMENTS

JP 09-293556 11/1997

* cited by examiner

*Primary Examiner*—Chandrika Prasad
(74) *Attorney, Agent, or Firm*—Gerald E. Hespos; Michael J. Porco

(57) ABSTRACT

A connector cover (10) has of two half pieces (20, 30) mounted on a rear of a connector housing (51). Upper and lower ribs (20U, 20L) are formed in one half piece (20) near a rubber plug (60) mounted in a rear end portion of the connector housing (51) at opposite sides of an extension (L) of the axial line of a through hole (61) of the rubber plug 60, through which hole a wire (W) is inserted. The upper and lower ribs define a first wire guide (22) to bend small-diameter wires (W1) drawn out backward from the through hole (61). The connector cover (10) also has a second wire guide (23) for bending the small-diameter wires (W1) bent by the first wire guide (22) in a direction opposite to a bending direction by the first wire guide (22).

11 Claims, 11 Drawing Sheets

CONNECTOR WITH A COVER WITH WIRE GUIDES BENDING A WIRE IN OPPOSITE DIRECTIONS

BACKGROUND OF THE INVENTION

1. Field of the Invention

The invention relates to a connector cover formed by a pair of cover pieces to be mounted on a connector housing and to a connector provided with a cover.

2. Description of the Related Art

Japanese Unexamined Patent Publication No. H09-293556 discloses a connector with a housing. A rubber plug is mounted in a rear end portion of the housing and a wire is drawn out backward through a through hole of the rubber plug. The wire is folded to extend forward and then is folded again to extend backward. A cover is mounted on the rear end of the housing and an inner wall of the cover engages the bent wire. The cover would be longer if the wire was not folded and a longer cover would be more likely to be broken by an external force. Thus, the entire length of the cover is shortened by bending the wire in the cover.

The wire of the above described connector is bent immediately after exiting from the rubber plug. Thus, sealing between the wire and the rubber plug or between the rubber plug and a rubber plug accommodating chamber easily is reduced. An evaluation test that measures the air pressure at which leakage occurs indicates that sealing ability varies significantly.

The present invention was developed in view of the above situation and an object thereof is to reduce a variation of sealability by a rubber plug.

SUMMARY OF THE INVENTION

The invention relates to a connector cover comprised of two cover pieces and to be mounted on a connector housing. The cover includes a first wire guide to be arranged near a resilient plug mounted in the housing and positioned at the substantially opposite sides of an extension of the axial line of a through hole of the resilient plug through which hole a wire is to be inserted. The first wire guide is adapted to bend the wire drawn out from the through hole. The cover also has a second wire guide for bending the wire bent by the first wire guide portion in a direction substantially opposite to a bending direction by the first wire guide.

The first wire guide preferably includes upper and lower ribs formed in one half piece. Accordingly, the wire can be drawn out substantially straight by the pair of ribs without being bent immediately after coming out from the resilient plug. Thus, an overall sealing ability of the resilient plug can be improved, and a variation of sealing ability by the resilient plug can be reduced.

The second wire guide may include a wire accommodating groove for accommodating the wire with a part of the wire exposed.

The second wire guide may be provided on one cover piece and the other cover piece may include at least one support for supporting an exposed part of the wire.

The second wire guide may include a wire accommodating groove for accommodating the wire with a part of the wire exposed, and the other half piece may include a support for supporting an exposed part of the wire. Accordingly, the wire can be prevented from coming out of the wire accommodating groove since the exposed part of the wire accommodated in the wire accommodating groove can be supported by the support.

The second wire guide may be arranged side by side with the first wire guide in a direction at an angle to a direction of the extension.

According to such a construction, the entire length of the connector cover can be shortened in forward and backward directions.

One or more pressing ribs may be provided at the wire accommodating groove to hold the wire press-fit in the wire accommodating groove.

According to such a construction, the wire can be held press-fitted in the wire accommodating groove by being pressed by the pressing ribs.

At least one protection wall for protecting the wire substantially from front by being arranged before the bent parts of the wire may be provided in the connector cover and preferably projects from the other cover piece.

The wire may be bent by the first and second wire guide portions to substantially have a mirrored S- or Z-shape.

The two cover pieces may be formed integral to each other by means of at least one hinge portion.

A locking structure may be provided for locking the two cover pieces in the assembled state.

The invention also relates to a connector with a housing having at least one resilient plug mount hole. At least one resilient plug formed with a through hole, through which a wire is passed is mounted in the resilient plug mount hole. The connector also includes the above described connector cover mounted on the housing such that a first wire guide portion is arranged near the resilient plug mounted in the housing and is positioned at the substantially opposite sides of an extension of the axial line of the through hole. The first wire guide is adapted to bend the wire drawn out from the through hole. A second wire guide is provided for bending the wire bent by the first wire guide in a direction substantially opposite to a bending direction by the first wire guide.

These and other objects, features and advantages of the present invention will become more apparent upon reading of the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
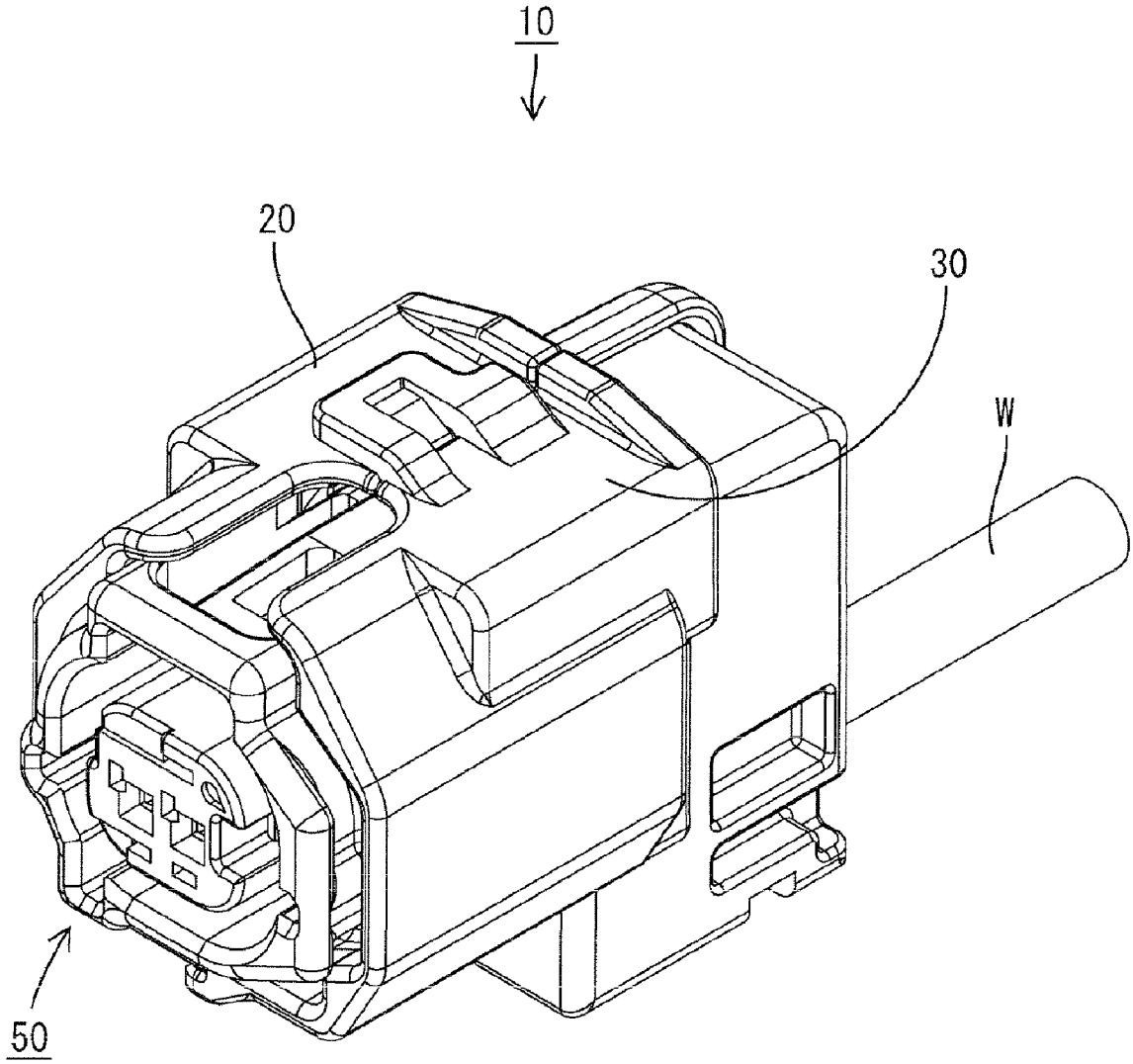
FIG. 1 is a perspective view showing a state where a connector cover is mounted on a rear part of a connector housing.
Figure 2:
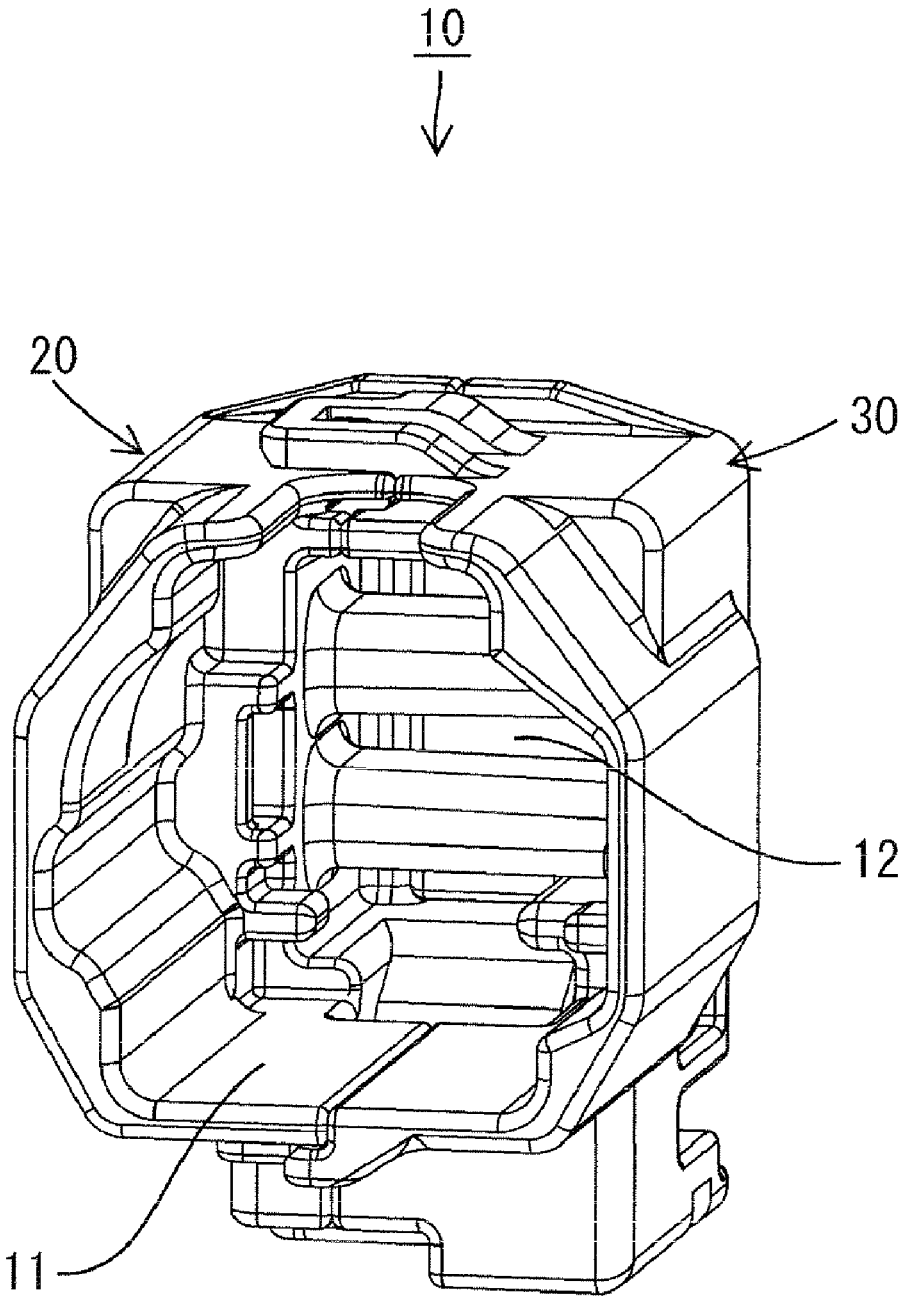
FIG. 2 is a perspective view showing an internal structure of the connector cover when obliquely viewed from front.

A connector cover in accordance with the invention is identified by the numeral 10 in FIGS. 1 to 11. The cover 10 is mounted on a rear part of a connector 50, as shown in FIG. 1, and is formed by first and second half pieces 20, 30 that are connected unitarily by a flexible hinge 40. However, the cover 10 may be subdivided into three or more pieces connected by hinges or the cover 10 may have two cover pieces that cover different amounts of the periphery of the connector 50. As shown in FIG. 2, the cover 10 has a forwardly open connector accommodating portion 11 in the form of a hood that is adapted to accommodate a housing 51 of the connector 50. The cover 10 also has a wire accommodating portion 12 for accommodating a wire W drawn out from a rear draw out surface of the housing 51.

Figure 3:
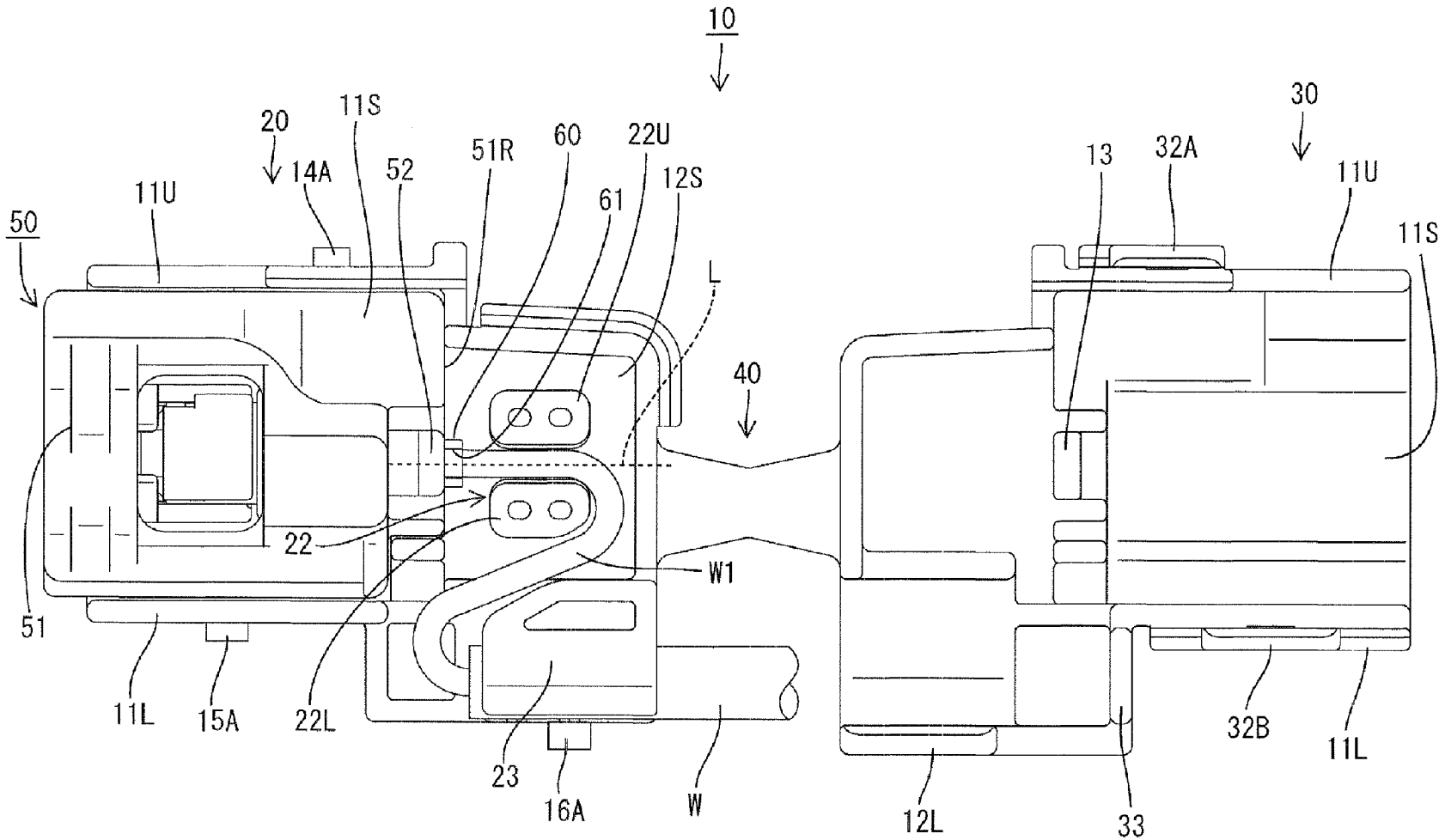
FIG. 3 is a front view showing a state before one cover (half) piece having the connector housing mounted therein is assembled with the other cover (half) piece.

As shown in FIG. 3, two housing locks 52 project from the opposite left and right sides of a rear end portion 51R of the housing 51 and two retaining holes 13 penetrate opposite side surfaces 11S of the connector accommodating portion 11. The housing locks 52 fit into retaining holes 13 as the cover pieces 20, 30 are assembled with the housing locks 52 to lock the cover 10 and the housing 51 in forward and backward directions and to hold the housing 51 in the connector accommodating portion 11 so as not to come out.

A locking structure for locking the cover pieces 20, 30 in the assembled state includes lock portions at separate positions on the cover 10.

Figure 4:
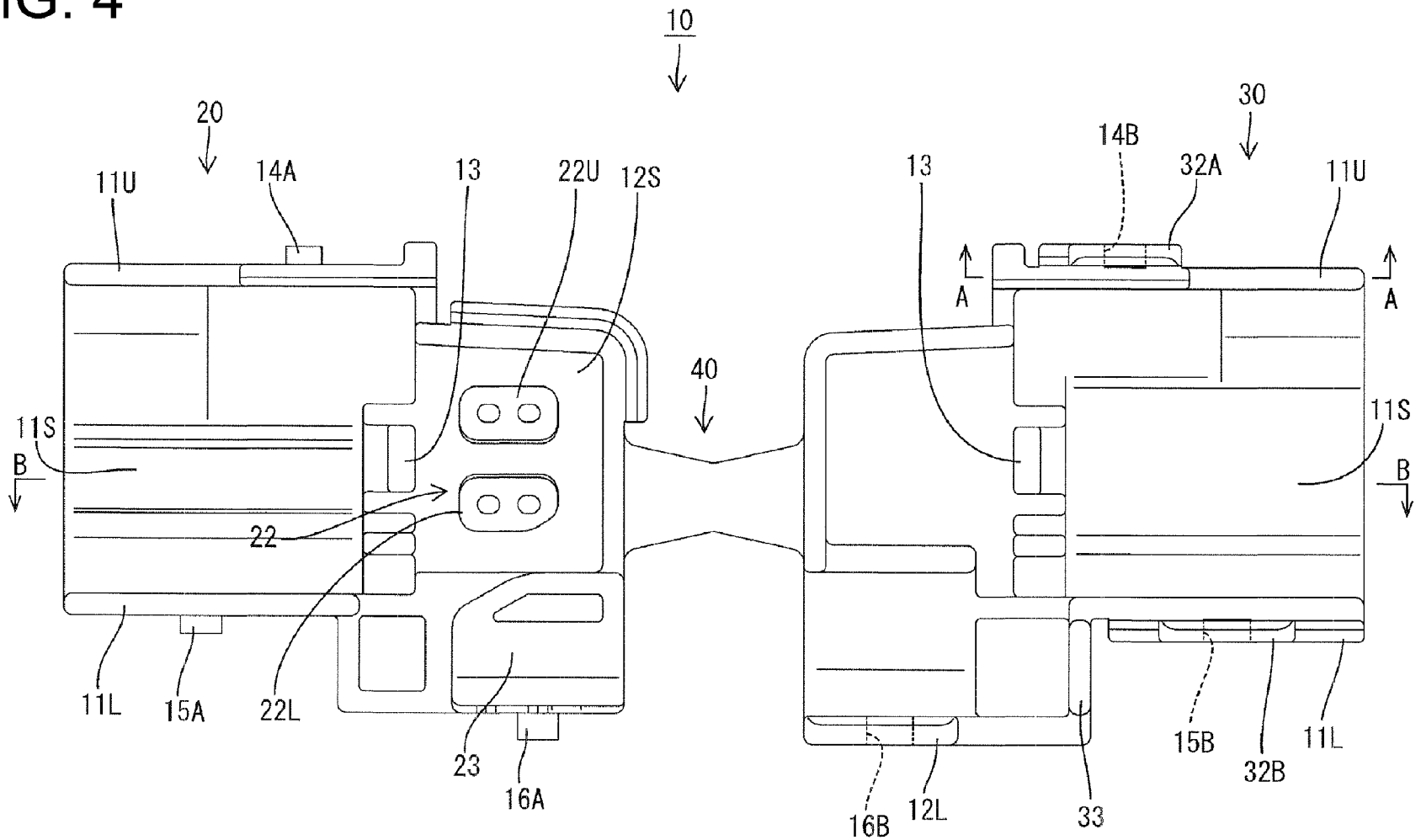
FIG. 4 is a front view of the connector cover before being assembled.
Figure 5:
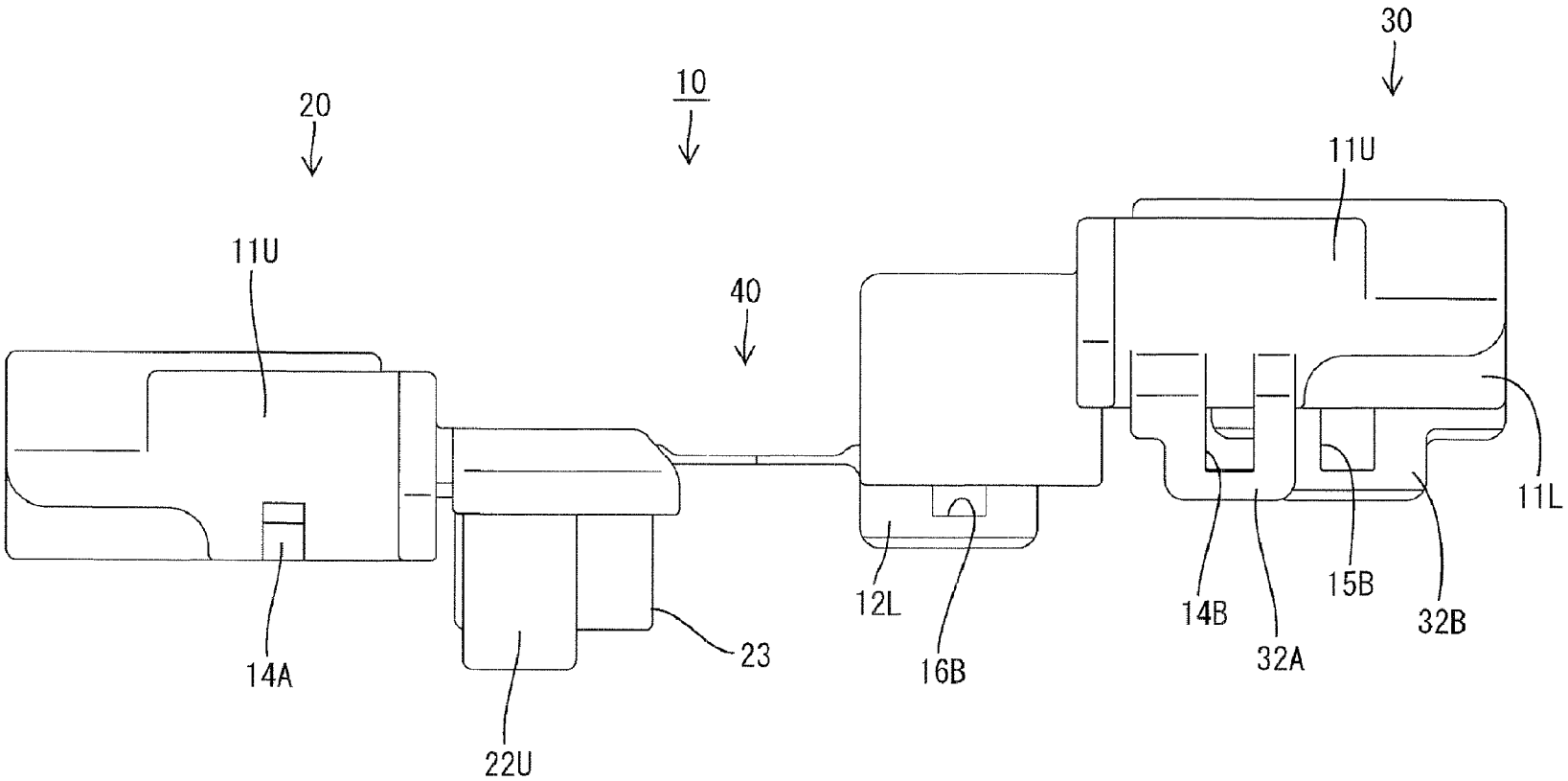
FIG. 5 is a plan view of the connector cover before being assembled.
Figure 8:
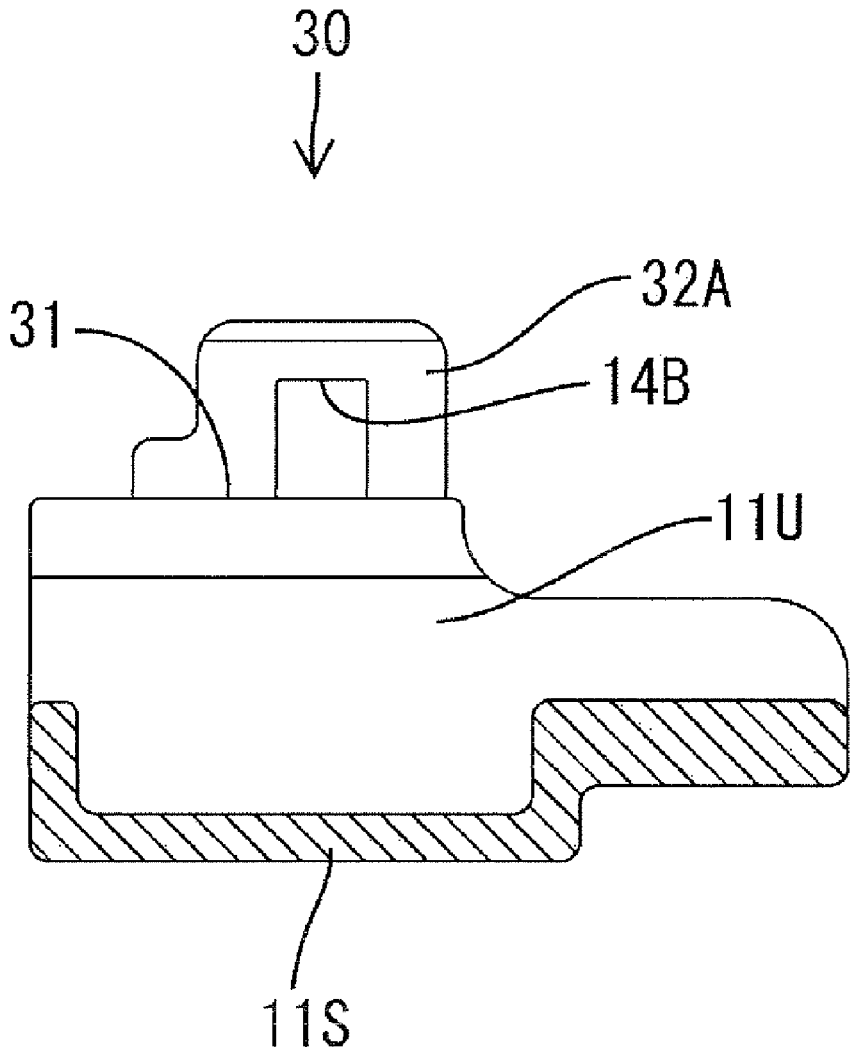
FIG. 8 is a section along A-A of FIG. 4.
Figure 9:
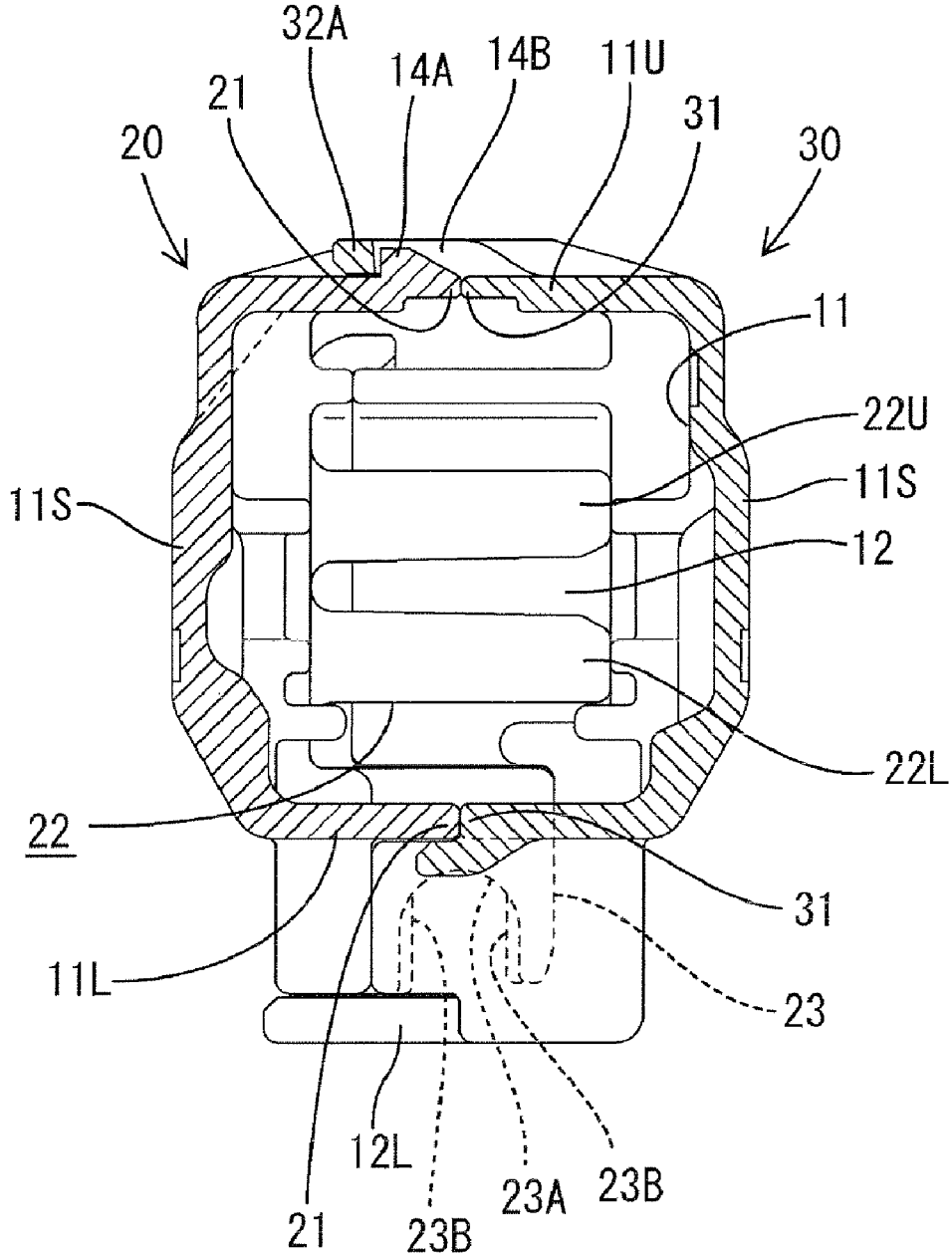
FIG. 9 is a section showing a locked state of a first lock portion.
Figure 10:
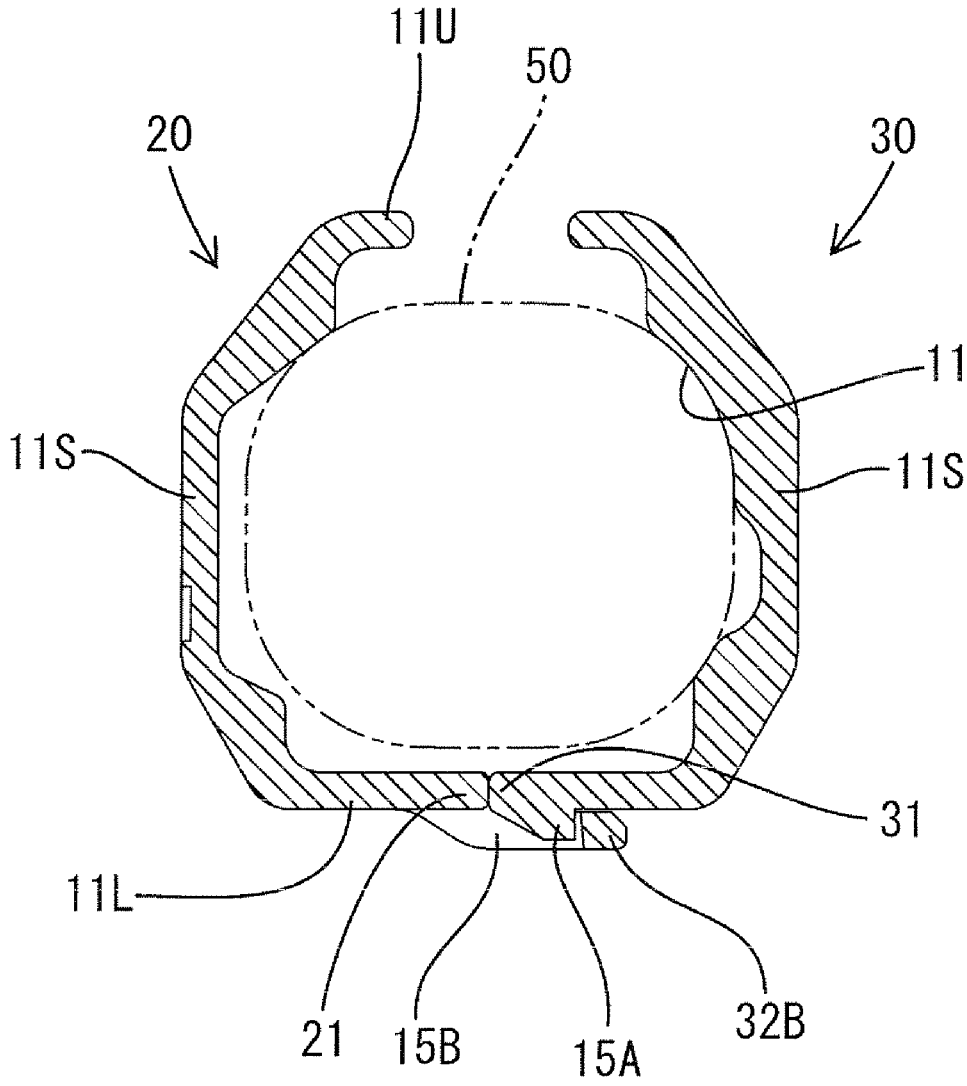
FIG. 10 is a section showing a locked state of a second lock portion.

A first lock portion is provided on an upper wall 11U of the connector accommodating portion 11. The first lock portion includes a first lock projection 14A on the first cover piece 20 and a first lock hole 14B in the second cover piece 30, as shown in FIG. 4. More particularly, the first cover piece 20 has a first contact 21 and the second cover piece 30 has a second contact 31 that contacts the first contact 21 when the cover pieces 20, 30 are assembled. A first lock piece 32A projects from the second contact 31 on the second cover piece 30 and the first lock hole 14B vertically penetrates the first lock piece 32A, as shown in FIG. 8. The first lock projection 14A engages an inner peripheral surface of the first lock hole 14B when the contacts 21, 31 are engaged, as shown in FIG. 9.

Figure 7:
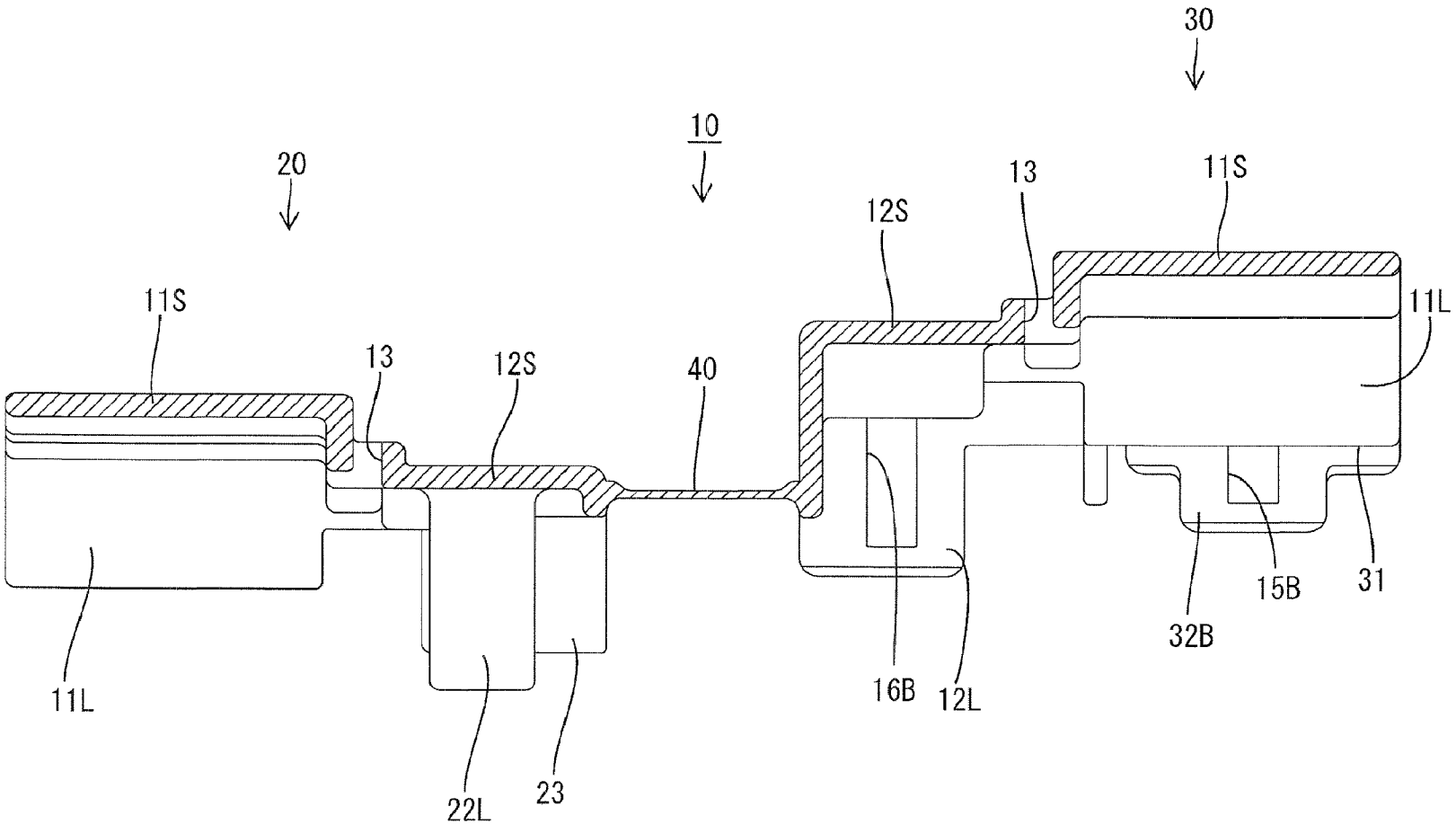
FIG. 7 is a section along B-B of FIG. 4.

The second lock portion is provided on a lower wall 11L of the connector accommodating portion 11. This second lock portion includes a second lock projection 15A on the first cover piece 20 and a second lock hole 15B formed in the second cover piece 30, as shown in FIG. 4. More particularly, a second lock piece 32B projects from the second contact 31 on the second cover piece 30 and the second lock hole 15B vertically penetrates the second lock piece 32B, as shown in FIG. 7. The second lock projection 15A engages with an inner peripheral surface of the second lock hole 15B when the contacts 21, 31 are engaged shown in FIG. 10.

Figure 6:
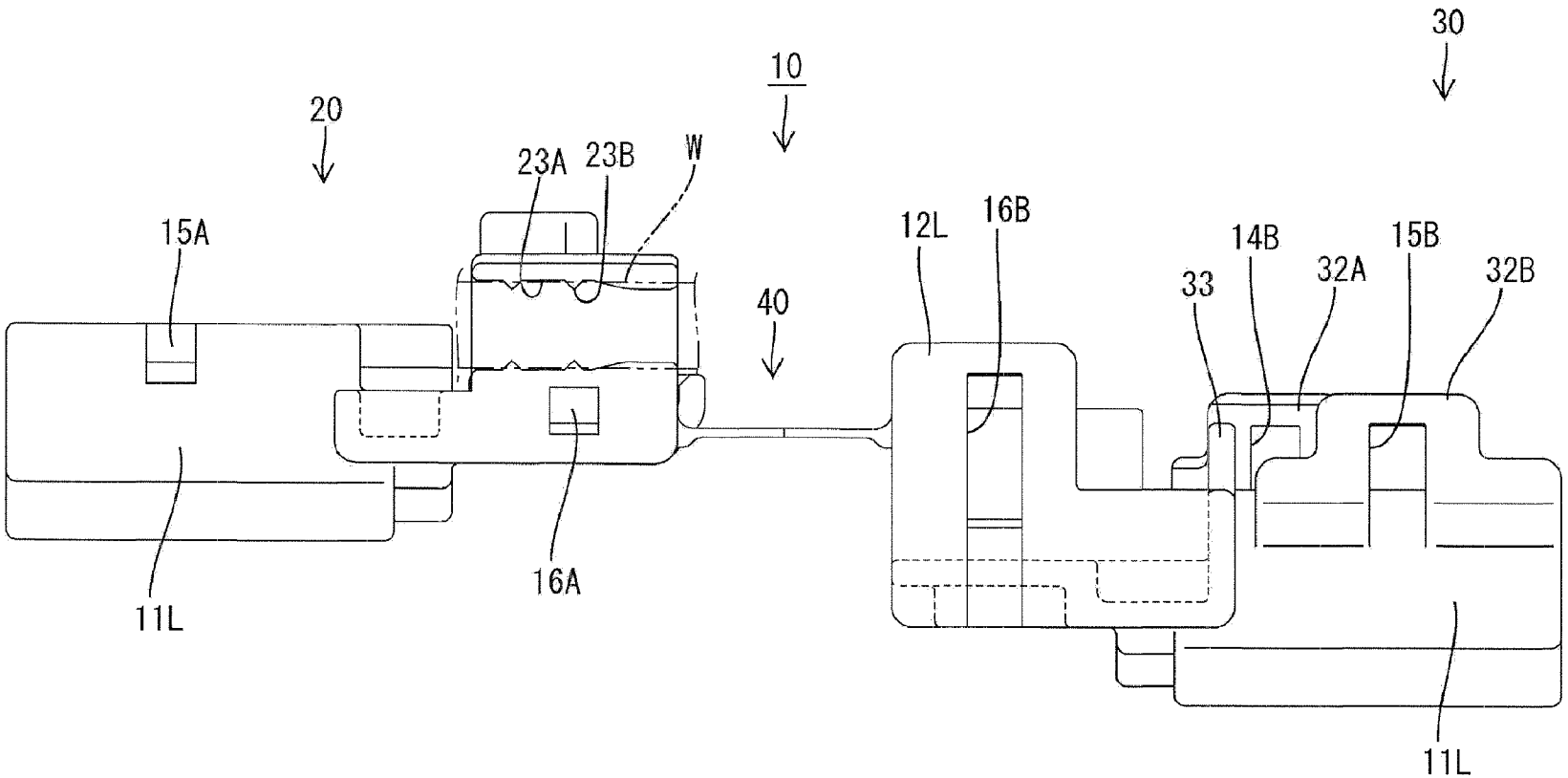
FIG. 6 is a bottom view of the connector cover before being assembled.
Figure 11:
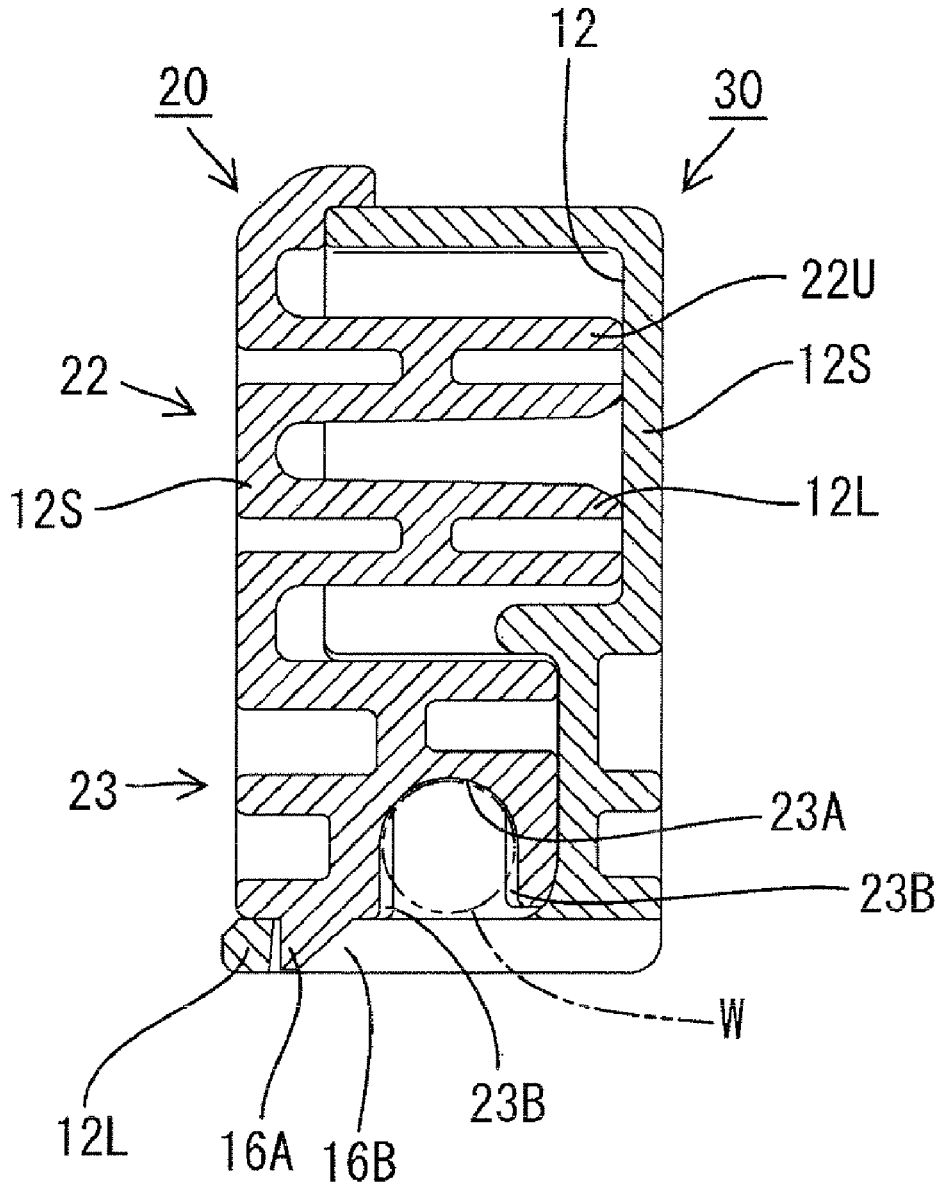
FIG. 11 is a section showing a locked state of a third lock portion.

The third lock portion is provided on a support 12L at a lower side of the wire accommodating portion 12. The third lock portion includes a third lock projection 16A on the first cover piece 20 and a third lock hole 16B formed in the second cover piece 30, as shown in FIG. 4. The third lock hole 16B vertically penetrates the support 12L by laterally cutting a part of the support 12L excluding the leading end, as shown in FIG. 6. The third lock projection 16A engages an inner surface of the third lock hole 16B near leading end of the support 12L, as shown in FIG. 11.

A resilient plug mount hole (not shown) penetrates the rear end portion 51R of the housing 51 in forward and backward directions and can receive a resilient or rubber plug 60. The resilient plug 60 is formed with a through hole 61 for receiving the wire W. The rear end of the resilient plug mount hole substantially aligns with the rear end portion 51R of the housing 51 in forward and backward directions. The resilient plug mount hole is behind a cavity for accommodating a terminal fitting (not shown) and communicates with the cavity.

As shown in FIG. 3, the resilient plug 60 is mounted to project back from the rear end of the resilient plug mount hole. The advantage of mounting the resilient plug 60 in such a state is that a clearance is unlikely to be formed between the resilient plug 60 and the resilient plug mount hole or between the wire W and the through hole 61 when the wire W is shaken. Thus, water is unlikely to penetrate into the cavity through the resilient plug mount hole.

As shown in FIG. 3, a first wire guide 22 is provided near the resilient plug 60 in the first cover piece 20. The first wire guide 22 includes upper and lower ribs 22U, 22L that project from a side surface 12S of the wire accommodating portion 12 and substantially face each other. The ribs 22U, 22L are at positions on opposite sides an extension L of the axial center of the through hole 61.

The wire W preferably is formed by bundling two small-diameter wires W1 and sheathing these small-diameter wires W1 with insulating resin. The small-diameter wires W1 are exposed by removing the insulating resin at an end portion of the wire W. Further, cores of the wires W1 are exposed by removing coatings made of insulating resin at end portions of the respective small-diameter wires W1 and the cores are connected (preferably by crimping) with the terminal fitting to electrically connect the cores and the terminal fitting.

A substantially R-shaped bending surface is formed at the rear of the lower rib 22L. The small-diameter wires W1 drawn out from the rear through hole 61 of the resilient or rubber plug 60 are bent around the bending surface at an angle greater than 90° and to extend obliquely forward.

A second wire guide 23 is provided below the lower rib 22L in the side surface portions 12S of the wire accommodating portion 12. The second wire guide 23 is arranged side by side with the first wire guide 22 in a direction substantially orthogonal to a direction of the extension L and at a side of the lower rib 22L substantially opposite to the upper rib 22U. As shown in FIG. 11, the second wire guide 23 has a wire accommodating groove 23A with an open lower side. Pressing ribs 23B are provided on the left and right sides of the inner wall of the wire accommodating groove 23A to face each other, and the wire W is press-fit in the wire accommodating groove 23A between the pressing ribs 23B. Ends of the small-diameter wires W1 toward the sheathed part of the wire W are at positions slightly before the front end of the second wire guide 23.

A lower part of the wire W is exposed when the wire W is in the wire accommodating groove 23A. However, the support 12L is below the wire accommodating groove 23A, and the exposed part of the wire W is supported and at least partly covered by the support 12L to hold the wire W in the wire accommodating groove 23A. In this way, the small-diameter wires W bent to extent obliquely forward by the first wire guide 22 are bent to extend substantially backward at the position before the second wire guide 23. Accordingly, the small-diameter wires W are bent to have a substantially mirrored S- or Z-shape (see FIG. 3). A protection wall 33 projects from the second cover piece 30 before the bent parts of the small-diameter wires W1 for protecting the small-diameter wires W1 from the front.

The connector 50 having the wire W mounted therein is mounted on the inner surface of the first cover piece 20 to fit the housing locks 52 into the retaining holes 13. The small-diameter wires W1 drawn out backward from the through hole 61 of the resilient plug 60 are passed between the ribs 22U, 22L and folded by the bending surface at the rear end of the lower rib 22L, to extend obliquely forward. The small-diameter wires W1 then are bent to extend backward at a position before the second wire guide portion 23 and the wire W then is pushed into the wire accommodating groove 23A. At this time, the wire W is held while being pressed by the pressing ribs 23B.

The two cover pieces 20, 30 are assembled with each other by bending the hinge 40 to at least partly cover the connector 50 by the second cover piece 30. Thus, the housing locks 52 are fit into the retaining holes 13 of the second cover piece 30. More particularly, the first lock projection 14A is fit into the first lock hole 14B, the second lock projection 15A is fit into the second lock hole 15B and the third lock projection 16A is fit into the third lock hole 16B. In this way, the connector cover 10 is formed by the two cover pieces 20, 30 and the connector 50 is held in the connector accommodating portion 11 so as not to come out. This causes the small-diameter wires W1 and the wire W to be at least partly covered by the wire accommodating portion 12. More particularly, in the case of a connector of an ABS sensor installed at a low position at an inner side of a tire, the small-diameter wires W1 can be protected from external objects e.g. flying stones and the like.

A waterproof performance test is conducted for the connector 50 mounted with the connector cover 10 in this way by conducting a sealability test. Specifically, air is fed into the cavity of the connector 50 mounted with the cover 10 and an air pressure at which air leakage occurs is measured to evaluate sealing ability. The small-diameter wires W1 drawn out backward from the through hole 61 of the resilient or rubber plug 60 are held straight by the both ribs 22U, 22L near the resilient or rubber plug 60 without being bent immediately bent. Thus, a clearance is unlikely to be formed between the resilient plug 60 and the resilient plug mount hole and/or between the small-diameter wires W1 and the through hole 61 of the resilient plug 60 and air leakage is unlikely to occur. Thus, an air pressure variation can be reduced.

As described above, the ribs 22U, 22L at the opposite sides of the extension L of the axial center of the through hole 61 are provided near the resilient plug 60. Thus, the small-diameter wires W1 drawn out backward from the through hole 61 can be held substantially straight and a variation of the sealability by the resilient or rubber plug 60 can be reduced.

The second cover piece 30 is provided with the supporting portion 12L. Thus, the wire W accommodated in the wire accommodating groove 23A of the second wire guide 23 can be supported. Further, the wire W can be press-fit in the wire accommodating groove 23A by the pressing ribs 23B.

The second wire guide 23 is arranged substantially side by side with the first wire guide 22 in the direction intersecting the direction of the extension L. Thus, the wire accommodating portion 12 can be made smaller in forward and backward directions and can avoid interference with other members.

The invention is not limited to the above described and illustrated embodiment. For example, the following embodiments are also included in the technical scope of the present invention.

The wire accommodating groove 23A with the open lower side is illustrated as the second wire guide 23 for accommodating the wire W in the above embodiment However, the second wire guide 23 may be a wire accommodating hole formed to penetrate substantially in forward and backward directions and into which the wire W is to be inserted.

The pressing ribs 23B are provided in the wire accommodating groove 23A in the above embodiment. However, ribs may project from the side surfaces 12S as the second wire guide 23 and the wire W are press fit between or into these ribs similar to the first wire guide 22 according to the invention.

Although the second wire guide 23 is arranged below the first wire guide 22 in the above embodiment, the second wire guide 23 may be arranged lateral to the first wire guide 22 according to the invention. In such a case, the wire W need not be drawn out backward from the second wire guide 23 and may be drawn out toward a lateral side.

What is claimed is:

1. A connector cover comprised of a pair of cover pieces and to be mounted on a housing, comprising:

a first wire guide to be arranged near a resilient plug mounted in the housing and positioned at the substantially opposite sides of an extension of the axial line of a through hole of the resilient plug, through which hole a wire is to be inserted, and adapted to bend the wire drawn out from the through hole, and a second wire guide portion for bending the wire bent by the first wire guide in a direction substantially opposite to a bending direction by the first wire guide portion.

2. The connector cover of claim 1, wherein the first wire guide includes upper and lower ribs formed in one half piece.

3. The connector cover of claim 1, wherein the second wire guide includes a wire accommodating groove for accommodating the wire with a part of the wire exposed.

4. The connector cover of claim 3, wherein the second wire guide is provided on one cover piece and the other cover piece includes at least one supporting portion for supporting an exposed part of the wire.

5. The connector cover of claim 4, wherein one or more pressing ribs are provided in or at the wire accommodating groove to hold the wire at least partly press-fitted in the wire accommodating groove.

6. The connector cover of claim 1, wherein the second wire guide is arranged side by side with the first wire guide in a direction at an angle to a direction of the extension.

7. The connector cover of claim 1, wherein at least one protection wall for protecting the wire substantially from front by being arranged before the bent parts of the wire is provided in the connector cover and projects from the other cover piece.

8. The connector cover of claim 1, wherein the wire is to be bent by the first and second wire guides to substantially have a mirrored S- or Z-shape.

9. The connector cover of claim 1, wherein the two cover pieces are joined integral to each other by at least one hinge.

10. The connector cover of claim 1, wherein a locking structure is provided for locking the two cover pieces in the assembled state.

11. A connector comprising:

a connector housing having at least one resilient plug mount hole, at least one resilient plug formed with a through hole, through which a wire is passed is at least partly mounted in the resilient plug mount hole, and a connector cover with two cover pieces, a first wire guide to be arranged near the resilient plug mounted in the housing and positioned at substantially opposite sides of an extension of the axial line of a through hole of the resilient plug, through which hole a wire is to be inserted, and adapted to bend the wire drawn out from the through hole, and a second wire guide portion for bending the wire bent by the first wire guide in a direction substantially opposite to a bending direction by the first wire guide portion.

* * * * *